US005373887A

United States Patent [19]

Glover

[11] Patent Number: 5,373,887

[45] Date of Patent: Dec. 20, 1994

[54] SECURITY GATE

[76] Inventor: Thomas H. C. Glover, P.O. Box 84218, Greenside, 2034 Johannesburg, South Africa

[21] Appl. No.: 77,635

[22] Filed: Jun. 17, 1993

Related U.S. Application Data

[63] Continuation-in-part of Ser. No. 868,680, Apr. 15, 1992, abandoned.

[30] Foreign Application Priority Data

Apr. 17, 1991 [ZA] South Africa ..... 91/2869

[51] Int. Cl.[5] ..... E05D 15/26

[52] U.S. Cl. ..... 160/206

[58] Field of Search ..... 160/201, 196.1, 199, 160/206, 133, 104

[56] References Cited

U.S. PATENT DOCUMENTS

| | | | |
|---|---|---|---|
| 1,290,176 | 1/1919 | Griffith | 160/199 X |
| 1,654,857 | 1/1928 | Brady | 160/196.1 |
| 1,864,796 | 6/1932 | Brady | 160/201 X |
| 1,945,729 | 2/1934 | Callender | 160/206 |
| 2,493,815 | 1/1950 | Guilbert | 160/206 |
| 2,898,988 | 8/1959 | Zoll | 160/133 X |
| 2,940,520 | 6/1960 | Cookson et al. | 160/133 X |
| 3,231,005 | 1/1966 | Cookson et al. | 160/133 X |
| 3,490,514 | 1/1970 | Duncan et al. | 160/133 X |
| 3,601,175 | 8/1971 | Wardlaw | 160/133 |

*Primary Examiner*—David M. Purol

*Attorney, Agent, or Firm*—Michael D. Bednarek

[57] ABSTRACT

A security gate for protecting an opening in a building such as a door, window or the like comprises an upper guide-way which extends along the length of the opening an elongated vertical rods which extend across the opening with horizontal links pivotally connecting the rods. Roller are connected to every four uppermost link. The rollers engage in the upper guide-way so that the gate can be moved easily.

19 Claims, 2 Drawing Sheets

56
7
54
12a
14b
14a
12
38
36
52
10
40
6
16
23
20
22
21
4
5
18
16a
12b 56
12a
54
16b
16a
18
10
16
12
14a
12b

SECURITY GATE

This application is a continuation in part of my copending patent application Ser. No. 07/868,680 filed Apr. 15, 1992 now abandoned.

FIELD OF THE INVENTION

This invention relates to a security gate for protecting an opening in a building such as a door, window or the like.

BACKGROUND TO THE INVENTION

Security gates are known for this purpose comprising elongated rods which extend across the opening either horizontally or vertically with pivoted connections that extend between the rods at right angles thereto. Typical of such gates are those shown in U.S. Pat. No. 2,940,520 (Cookson et al), U.S. Pat. No. 3,231,005 (Cookson et al), U.S. Pat. No. 3,490,514 (Duncan et al), U.S. Pat. No. 3,601,175 (Wardlaw), FR 1.183.386 (Coulon) and GB 581,560 (Griggs et al). While having a number of advantages, these gates have the disadvantage that the gate has to be rolled on to a roller for storage and the roller takes up a considerable amount of space. U.S. Pat. No. 1,654,857 (Brady) and U.S. Pat. No. 1,864,796 (Brady) also show arrangements in which the rods are moved into storage spaces that have to be allowed for them.

It is also known to make such gates with inclined connections which slide relative to one or more of the rods into a position very nearly parallel to the rods when the gate is in the open position and to an inclined position when the gate is in the protective position spanning the opening. Examples of such a gate are shown in U.S. Pat. No. 1,290,176 (Griffith) and U.S. Pat. No. 4,006,768 (Horgan). Although these gates are usually very easy to use, they are usually made of fairly light material and the connections normally would present no undue problem to the professional thief who wishes to cut through them. In addition when all the connections between two adjacent rods are cut, the gate can be opened easily by pushing the gate parts towards the ends of the gate which are secured to e.g. the walls of the opening. In this context the connections will always be exposed when the gate is in the protecting or open position and will not be protected by any robust plates which may inhibit a thief.

More robust gates have been made with some of the rods being guided so that the gate collapses. U.S. Pat. No. 641,262 (Bode), U.S. Pat. No. 1,945,729 (Callender), U.S. Pat. No. 2,493,815 (Guilberti) and GB 722,961 (Hill) illustrate typical examples of such gates. These gates normally have vertical rods which are connected together by horizontal connecting pieces. The ends of alternate rods (hereinafter called "the guided rods") are guided in horizontal guide-ways that run above and below the opening. Thus when it is desired to move the gate into the open position, the guided rods are moved towards each other and the rods between them are moved outwardly so that the gate takes up a compact position. In order to make the rods and connecting pieces sufficiently strong to resist being cut by, say, a hack saw, these parts have to be made of heavy metal. This tends to make the gate extremely heavy and difficult to move from the protective to the open positions.

SUMMARY OF THE INVENTION

I have found that it is desirable for the gate to be carried by rollers in the upper guide-way so that the gate can be moved easily. In order to provide such an arrangement which allows the gate to move into a compact condition when in the open position, I have found that it is necessary for the rollers to be mounted on connectors between pairs of adjacent rods and for the alternate pairs of adjacent rods to be free of the guide-ways. Thus these alternate pairs of rods and the connecting pieces therebetween will stand forward of the plane in which the guided rods are located.

An embodiment of the invention will now be described by way of example with reference to the accompanying drawings.

SHORT DESCRIPTION OF DRAWINGS

FIG. 1 is a front view of a security gate of the invention in its extended protecting position with the top support and bottom guide omitted for clarity, FIG. 2 is a plan view of the gate as shown in FIG. 1, FIG. 3 is a plan view similar to FIG. 1 of the gate shown in its retracted position, FIG. 4 is a detail transverse sectional view on line 4—4 of FIG. 1 of the gate showing the top support, FIG. 5 is a similar detail sectional view on line 5—5 of FIG. 1, FIG. 6 is a sectional view on line 6—6 of FIG. 1 showing the bottom guide, FIG. 7 is a transverse sectional view on line 7—7 of FIG. 1 showing the side fixing for the fixed end of the gate, FIG. 8 is a detail of a modified gate of the invention, and FIGS. 9 and 10 are plan views of the end links of the gate.

DESCRIPTION OF PREFERRED EMBODIMENT

Figure 1:
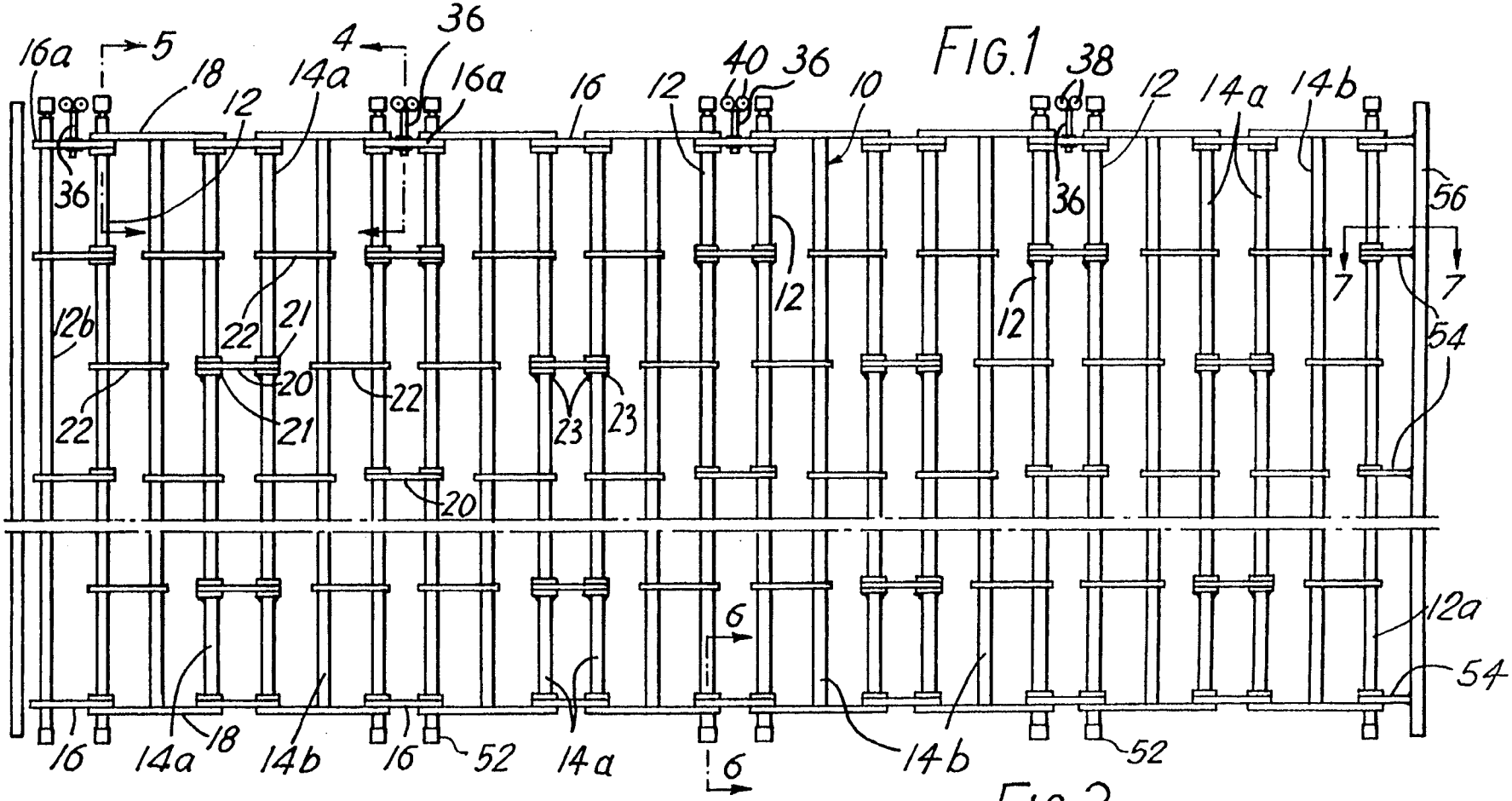
Figure 2:
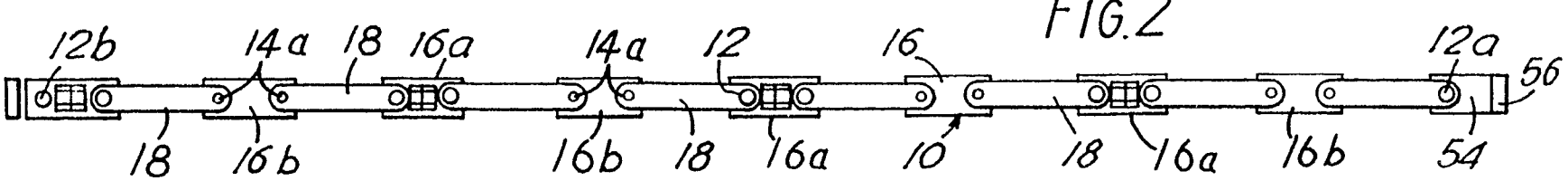

Referring now to FIG. 1 there is shown a security gate 10 of the invention. The gate 10 comprises a plurality of vertical members 12 and 14 which comprise thick steel rods (conveniently having a nominal diameter of 12 mm) that are joined together by sets of horizontal connecting pieces. These connecting pieces are in the form of end links 16 and 18 at the upper and lower ends of the vertical members and intermediate links 20 and 22 between their ends. The links comprise thick steel plates (conveniently having a thickness of 7 mm). The gate 10 when in its protective or closed position extends over the entire area of an opening which may be a door opening, a patio door opening, a window opening or the like.

The vertical members 12 (hereinafter called "guided rods") are arranged in pairs. Between each pair of guided rods 12 are four members 14. The members **14*a*, which are midway between the guided rods 12, are hereinafter called "the intermediate rods". The members 14*b*, each of which is located between a guided rod 12 and an intermediate rod 14*a*** are hereinafter called reinforcing rods.

The members 14 extend over the height of the opening. The guided rods 12 are somewhat longer for the purpose which will be described below.

The horizontal links 18 (hereinafter called "the fixed end links") are each fixed to a guided rod 12 and to the intermediate rod **14*a* closest thereto near the upper and lower ends thereof. An intermediate reinforcing rod 14*b*** is also connected to the said fixed end link 18. The links 16a are pivotally connected between the guided rods 12 near their upper and lower ends. The links 16b are pivotally connected between the intermediate rods 14a near their upper and lower ends.

The horizontal links 22 (hereinafter called "the fixed links") are fixed to the vertical members to which they are connected. There are two sets of these links. One set of the fixed links 22 connects a guided rod 12 and the adjacent reinforcing rod 14b and the other set of fixed links 22 connects the reinforcing rod 14b to the adjacent intermediate rod 14a (i.e. the fixed links 22 connect together the vertical members that are connected at their ends to the links 18).

The links 20 (hereinafter called "the pivoted links") pivotally connect together (a) the guided rods 12 of each pair and (b) the intermediate rods 14a of each pair of intermediate rods (i.e. the pivoted links 20 connect together the vertical members that are connected at their ends to the links 16).

The pivotted links 20 are held in the horizontal position by means of washers 21 that are secured to the vertical members by welds indicated at 23.

Figure 4:
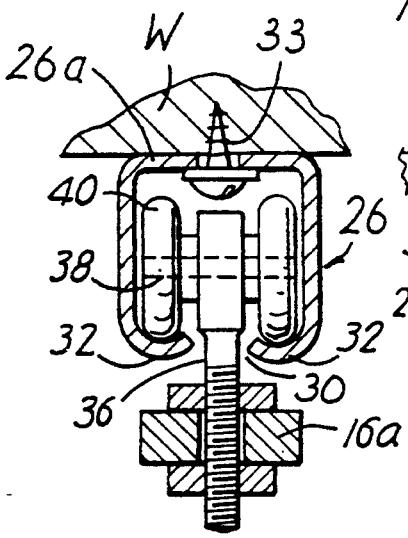
Figure 5:
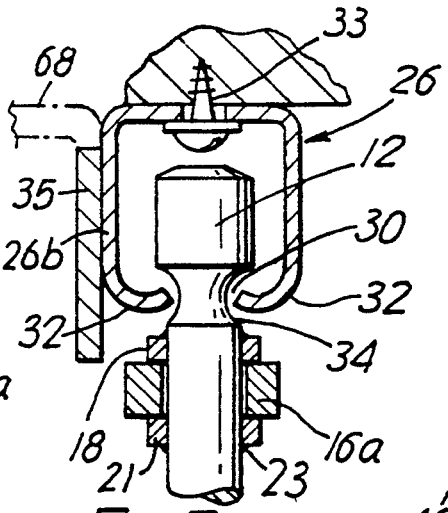
Figure 6:
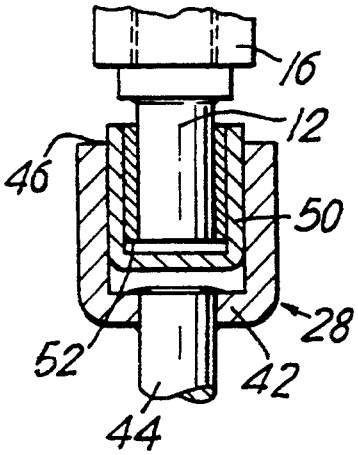
Figure 7:
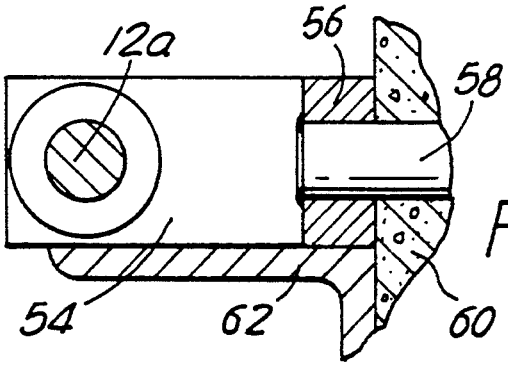
Figure 9:
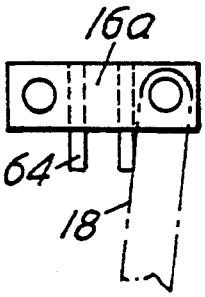
Figure 10:
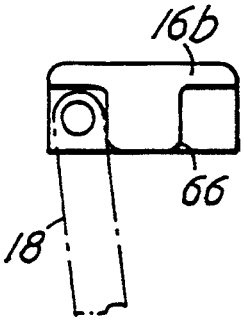

A top support 26 (shown in FIGS. 4 and 5) extends across the gate above the opening and a bottom guide 28 (shown in FIG. 6) runs there-below. In addition to guiding the guided rods 12 as will be described below, the support 26 and bottom guide 28 firmly hold the ends of the guided rods 12 in position so that the gate 10 cannot be interfered with by a potential thief pulling members out of the support 26 and guide 28.

The top support 26 is generally in the form of an inverted channel having a longitudinally extending passage 30 in its lower surface which is formed by concave flanges 32. Securing screws 33 pass through openings in the base 26a of the channel 26 and engage the wall W there-above to secure the channel 26 in position. A plate 35 (shown only in FIG. 5) runs along the inner arm 26b of the channel 26 and extends therebelow to lie below the ends of the shorter members 14.

The upper ends of the guided rods 12 are received within the support 26, there being a throat 34 formed in such ends at the location where they pass through the passage 30. The upper parts of guided rods 12 are connected together by robust upper links 16a (hereinafter called "the carrier links"). The shanks of carrier members 36 (shown in FIG. 4) pass through the carrier links 16a. Each member 36 carries a pair of transverse pins 38 on the ends of which are carried rollers 40 that engage and roll on the flanges 32 and thereby carry the gate 10 on such flanges 32.

The bottom guide 28 comprises an open channel 42 that has fixing pins 44 passing through its base and being fixed into the concrete floor (not shown) adjacent an opening. An inner channel 50 is pressed into the channel 42 and the lower end of each of the guided rods 12 is received therein. This channel 50 covers the fixing pins to prevent a potential thief obtaining access thereto. The ends carry rolling sleeves 52 thereon respectively to facilitate movement in the inner channel 50.

At one end of the gate is a vertical member 12a which is pivotally carried in horizontal plates 54 that are welded to a vertical end plate 56. The plate 56 is secured by pins 58 passing into the wall 60 defining the opening. A robust angle member 62 is welded to the plate 54 to protect it from being tampered with by a person endeavouring to remove the gate from its fixing.

At the other end of the gate 10 is a locking arrangement (not shown) which can be of conventional form to lock the gate in its closed or protective condition.

Figure 3:
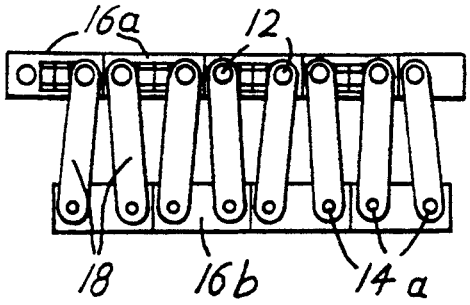

When it is desired to open the gate 10, the locking arrangement is unlocked and the front most intermediate rod 14a is drawn outwardly and backwardly. The links 18 and 22 will pivot about the rods 12 and 14a so that, when the gate is fully open, i.e. in the retracted condition shown in FIG. 3, the alternate links 16 and 20 (which latter are not illustrated in this Figure) extend in two lines and the links 18 and 22 (which latter are not illustrated in this Figure) are inclined thereto. In the retracted condition, the gate 10 extends over a small proportion of the area covered by the gate 10 when in its extended position. In the embodiment shown, where there are twenty five vertical members 12 and 14, the retracted length of the gate 10 is about one sixth of its extended length.

Each link 16a has a pair of projections 64 on its inner-side (i.e. the sides of the links 16a facing each other) extending into to the path of movement of the links 18 to limit the swinging movement of the connecting links 18. Similarly each link 16b has an enlargement on its inner side extending into the path of movement of the links 18 to prevent the links swinging too far. In this way the movement of the parts of the gate are controlled.

It will be seen that the reinforced reinforcing rods 14b are reinforcing members which ensure that there are not large spaces between the guided rods 12 and intermediate rods 14a.

I have found that the gate 10 provides a very robust security closure that is difficult to break and that is aesthetically acceptable in both its protective and retracted positions. Furthermore by having the gate carried on rollers, it can comprise strong heavy metal plates and rods without affecting the ease with which the gate can be moved by hand from its protective position to its retracted position and vice versa.

Because of the provision of the heavy plate 35 next to the upper links, a thief would not have adequate room to use a hack saw to cut through the upper links. The plate 35 extends into the path of movement of the intermediate rods 14a and thereby ensures that the links 18 swing outwardly of the support when being moved into the retracted position.

Figure 8:
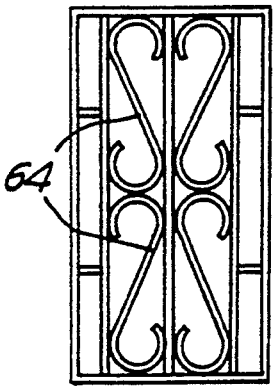

The invention is not limited to the precise constructional detail hereinbefore described and illustrated. For example, the reinforcing rods 14b may be ommitted. Alternatively there may be additional reinforcing rods 14b and the links 18 may be longer. In such an arrangement the gate, when in its retracted condition, will cover a smaller length of the opening although of course the transverse space occupied by the gate will be increased. Furthermore with such an arrangement, a decorative unit such as shown in FIG. 8 can replace the vertical members connected to the links 18, which latter too can form part of the units.

The links can be of different sizes with the pivoted links being shorter than the other links. The washers could be attached to the rods by crimping or by other means.

The gate may comprise more or less vertical members. The gate may be in two parts which meet intermediate their ends (normally in the centre) when closed and suitable locking means may be provided to lock the parts together.

Instead of the channel member being connected by means of a screw through the base of the channel (as shown in full lines in FIG. 5), the plate 35 may be bolted to a wall and the channel welded thereto. For a hung channel, an angle iron support 68 (as shown in chain lines in FIG. 5) may have one arm secured to the underside of the beam and the channel welded to the vertical arm.

While the specification and drawings illustrate embodiments of the invention, it will be understood that the spirit and scope of the invention is defined by the claims which follow.

I claim:

1. A security gate comprising:

a plurality of vertical members including pairs of guided members and pairs of intermediate members located between the pairs of guided members, first sets of horizontal links, each first set of links connecting together the guided members of the pairs of guided members, and said first sets of links forming a first group of sets of links, one of the links of each first see of horizontal links being the uppermost link of said set, second sets of horizontal links, each said second set of links connecting together the intermediate members of the pairs of intermediate members, third sets of horizontal links, said third sets of links forming a second group of sets of links, each said third set of links connecting together a guided member with an intermediate member, one of the links of each third set of horizontal links being the uppermost link of said set, an elongated upper horizontal guide with horizontal support surface means and carrier means engaging the support surface means to be able to move along the guide, said carrier means being mounted respectively on the uppermost links of the sets of links of one of said groups of sets of links, the arrangement being such that the gate can be moved from (a) an extended protective position in which said sets of links are aligned, to (b) a retracted open position in which the first and second sets of links are laterally spaced from and substantially parallel to each other.

2. A security gate as claimed in claim 1 wherein the horizontal guide comprises a pair of surfaces which are spaced apart by an elongated opening and which constitute said support surface means, and wherein the guided members are longer than the intermediate members, and wherein the upper ends of the guided members are received in the opening.

3. A security gate as claimed in claim 2 wherein a downwardly projecting member is provided on one side of said guide to a position in which it lies in the path of the shorter vertical members.

4. A security gate as claimed in claim 2 wherein the longer vertical members have throats at the location of the opening.

5. A security gate as claimed in claim 1 wherein the horizontal guide comprises a pair of surfaces spaced apart by an opening, and wherein each said carrier device comprises a member having two cross-pieces and four rollers carried at the ends of the cross-pieces, said rollers running on said surfaces.

6. A security gate as claimed in claim 5 wherein the horizontal guide is generally of channel shape.

7. A security gate as claimed in claim 1 wherein at least some of said links have projections to prevent other links from pivoting too far relative thereto.

8. A security gate as claimed in claim 1 further comprising a lower guide wherein the lower ends of the guided member are received, said lower guide comprising an upwardly open channel member which has openings in its bottom part through which fixing means can pass to secure the guide to the ground, and an inner liner which fits tightly in said channel member and covers said fixing means.

9. A security gate as claimed in claim 1 in which said vertical members are comprised by solid rods.

10. A security gate as claimed in claim 9 further comprising washers mounted on said rods, links of said first and second sets of links resting on and being carried by said washers.

11. A security gate as claimed in claim claim 1 wherein the horizontal guide comprises a pair of surfaces that are spaced apart by an opening and that constitute said support surface means, and wherein the pairs of rods connected together by the links carrying the carrier means are longer than the other rods and said pairs of rods extend into said opening, the other said rods being shorter and not extending into said opening.

12. A security gate as claimed in claim 1, wherein the said one group of sets of links is said first group of sets of links.

13. A security gate comprising a main upper guide incorporating a support surface, a plurality of pairs of main vertical rods, a plurality of sets of main horizontal links, each said set connecting together a pair of said main rods, the upper link of each set of main links constituting a carrier link, a plurality of pairs of intermediate vertical rods, a plurality of sets of intermediate links, each said set of intermediate links connecting together a pair of said intermediate rods, a plurality of sets of horizontal connecting links, each set of connecting links connecting a main rod with an intermediate rod, and a plurality of carriers supported by said support surface to move therealong, said carriers being respectively mounted on said carrier links between their connections to the main rods.

14. A security gate as claimed in claim claim 13 wherein said main upper guide comprises a pair of support surfaces having an opening therebetween, wherein the main rods extend through said opening, and wherein the intermediate rods terminate at their upper ends below said guide.

15. A security gate as claimed in claim 13 further comprising an additional vertical rod extending between and joining the intermediate links between a pair of intermediate rods.

16. A security gate as claimed in claim 13 further comprising a protective plate running alongside the carrier links.

17. A security gate as claimed in claim 16 wherein said protective plate is carried by said main upper guide.

18. A security gate as claimed in claim 13 further comprising a lower guide, the lower ends of said main rods being received within said lower guide and the lower ends of said intermediate rods being spaced upwardly away from said lower guide.

19. A security gate as claimed in claim 13 wherein each said rod is a solid rod.

* * * * *